US009555446B2

(12) United States Patent
Archer

(10) Patent No.: US 9,555,446 B2
(45) Date of Patent: Jan. 31, 2017

(54) MATERIAL SEPARATOR

(71) Applicant: Andrew J. Archer, Las Vegas, NV (US)

(72) Inventor: Andrew J. Archer, Las Vegas, NV (US)

( * ) Notice: Subject to any disclaimer, the term of this patent is extended or adjusted under 35 U.S.C. 154(b) by 0 days.

(21) Appl. No.: 14/519,038

(22) Filed: Oct. 20, 2014

(65) Prior Publication Data

US 2015/0034533 A1 Feb. 5, 2015

Related U.S. Application Data

(62) Division of application No. 13/843,881, filed on Mar. 15, 2013, now Pat. No. 9,333,537.

(51) Int. Cl.

| | |
|---|---|
| ***B07B 1/42*** | (2006.01) |
| ***B07B 4/08*** | (2006.01) |
| *B07B 1/28* | (2006.01) |

(52) U.S. Cl.

CPC ..... *B07B 4/08* (2013.01); *B07B 1/284* (2013.01); *B07B 1/286* (2013.01); *B07B 1/42* (2013.01)

(58) Field of Classification Search

CPC ..... B07B 4/08; B07B 1/284; B07B 1/286; B07B 1/42

USPC ..... 209/239

See application file for complete search history.

(56) References Cited

U.S. PATENT DOCUMENTS

| | | | |
|---|---|---|---|
| 1,606,301 | A | 11/1926 | Jones |
| 3,277,697 | A | 10/1966 | Wittkuhns |
| 4,956,078 | A | 9/1990 | Magerowski et al. |
| 5,868,259 | A | 2/1999 | Bielagus |
| 7,422,114 | B2 | 9/2008 | Guptail |
| 2006/0076279 | A1 | 4/2006 | Guptail |
| 2011/0084004 | A1 | 4/2011 | Carr |

FOREIGN PATENT DOCUMENTS

| | | |
|---|---|---|
| WO | WO 93/24245 A1 | 12/1993 |

OTHER PUBLICATIONS

United States Patent and Trademark Office, Office Action mailed Nov. 20, 2013 in U.S. Appl. No. 13/843,881, 12 pages.

WIPO, U.S. International Search Authority, International Search Report and Written Opinion mailed Jun. 4, 2013 in international Patent Application No. PCT/US2013/032672, 11 pages.

*Primary Examiner* — Howard Sanders

(74) *Attorney, Agent, or Firm* — Inskeep IP Group

(57) ABSTRACT

A system and method for separating mixed materials employing an angled screen that is moved through a vertically oriented circular path by a single drive element.

5 Claims, 6 Drawing Sheets

MATERIAL SEPARATOR

RELATED APPLICATIONS

This application claims priority to U.S. application Ser. No. 13/843,881 filed Mar. 15, 2013 entitled Material Separator, which is hereby incorporated herein by reference in its entirety.

FIELD OF THE INVENTION

The present invention relates to systems and methods for the separation of mixed materials.

BACKGROUND OF THE INVENTION

The ability to efficiently separate mixed materials, such as household recycling and construction waste, is of increasing importance and economical significance. For example, efficiently extracting and separating various types of recyclable materials from variable mixed waste streams is a critical factor when considering the economic viability of a recycling program. Material Recovery Facilities (MRFs) must be able to separate or sort mixed recyclable materials to a significantly high purity, for example 10 percent. If the final sorted and bailed product, for example similar plastic materials, does not achieve the purity required for purchase on the commodity market at a desired price, the product represents wasted resources and a financial loss for the MFR.

A critical step in the sorting or separation process is the dimensional sorting of materials. Several types of dimensional sorting equipment or separators have been developed, however each of these known types of separators continues to suffer from significant shortcomings. Ballistic-type separators function by rotating an angled surface in a relatively small vertical circle, thereby projecting the mixed materials deposited upon the surface into the air. The materials are separated according to each materials ballistic properties and trajectory created by the movement of the surface.

These types of separators may employ a surface that is unitary or one that is divided into various portions or sections that may move in unison or separately relative to one another. However, in order to achieve the desired motion of the surface, known separators employs a plurality of different motors. For example, different motors may be associated with each of the sides or corners of the unitary surface or with each of the various portions or sections of the surface. An obvious shortcoming of these separators is the increased maintenance associated with the calibration of the multiple motors to achieve the desired movement of the surface.

Another type of dimensional separator employs an angled surface formed of a bank of vertically rotating discs. The discs may have a roughly triangular or irregular shape and may be oriented non-symmetrically along axles or shafts. The axles rotate the discs towards an elevated side of the surface, thereby carrying certain materials up the surface while other materials fall towards the lower side of the surface. One obvious shortcoming of disc-type separators is the increased maintenance resulting from the wear associated with a surface formed of entirely moving parts, e.g. discs, axles, bearing.

Another disadvantage with disc-type separators is a propensity for materials to wrap themselves around and attach themselves to the discs and rotating spaces between the discs. These wrapped materials can lead to decreased throughput and efficiency due to the equipment's down-time required to remove the materials and increased impurities due to the effect of the wrapped materials on the migration of other materials. On disc-type systems employing multiple drive motors, required maintenance may also be undesirably high due to the need to calibrate the efforts of the different motors.

Finally, both of the above types of separator sort small materials or fines by providing voids or holes in the surface through which the fines can pass. The fines pass through the surface and ultimately into a vessel or onto a conveyor belt for transfer. However, known separators suffer from the fact that the fines must fall over equipment structure residing under the surface and above the output vessel or conveyor belt. These structures include drive motors and other moving and often sensitive attachments points of the equipment. This separation technique has the shortcoming of resulting in increased maintenance and repair due to the falling fines contaminating or damaging the components of the separator residing under the surface and above the output.

In view of the above described failures of the known dimensional separators, there exists a significant need in the art for more robust separators having increased efficiency and decreased maintenance and repair costs.

OBJECTS AND SUMMARY OF THE INVENTION

The present invention provides a robust mixed material separator having increased efficiency and decreased maintenance and repair costs. These objectives are achieved in one embodiment of the present invention by providing a separator having a drive element coupled to a drive shaft, a pair of link arms coupling the drive shaft to a follower shaft, and a deck coupled to the drive shaft and the follower shaft at a point offset from an axis of rotation of the drive shaft and an axis of rotation of the follower shaft.

In another embodiment of the present invention, these objectives are achieved by providing a mixed material separator having a single drive element that is coupled to a drive shaft; and a deck that unitarily rotates vertically about an axis of rotation of the drive shaft.

In certain embodiments of the present invention, the deck may employ a screen that is statically elevated above a tray.

These objectives are also achieved by a method of the present invention including the steps of rotating a drive shaft with a drive element; transferring the rotation of the drive shaft to a follower shaft; rotating a deck about an axis of rotation of the drive shaft and an axis of rotation of the follower shaft; depositing mixed materials upon the deck; and separating the mixed materials.

BRIEF DESCRIPTION OF THE DRAWINGS

These and other aspects, features and advantages of which embodiments of the invention are capable of will be apparent and elucidated from the following description of embodiments of the present invention, reference being made to the accompanying drawings, in which.

DESCRIPTION OF EMBODIMENTS

Figure 1:
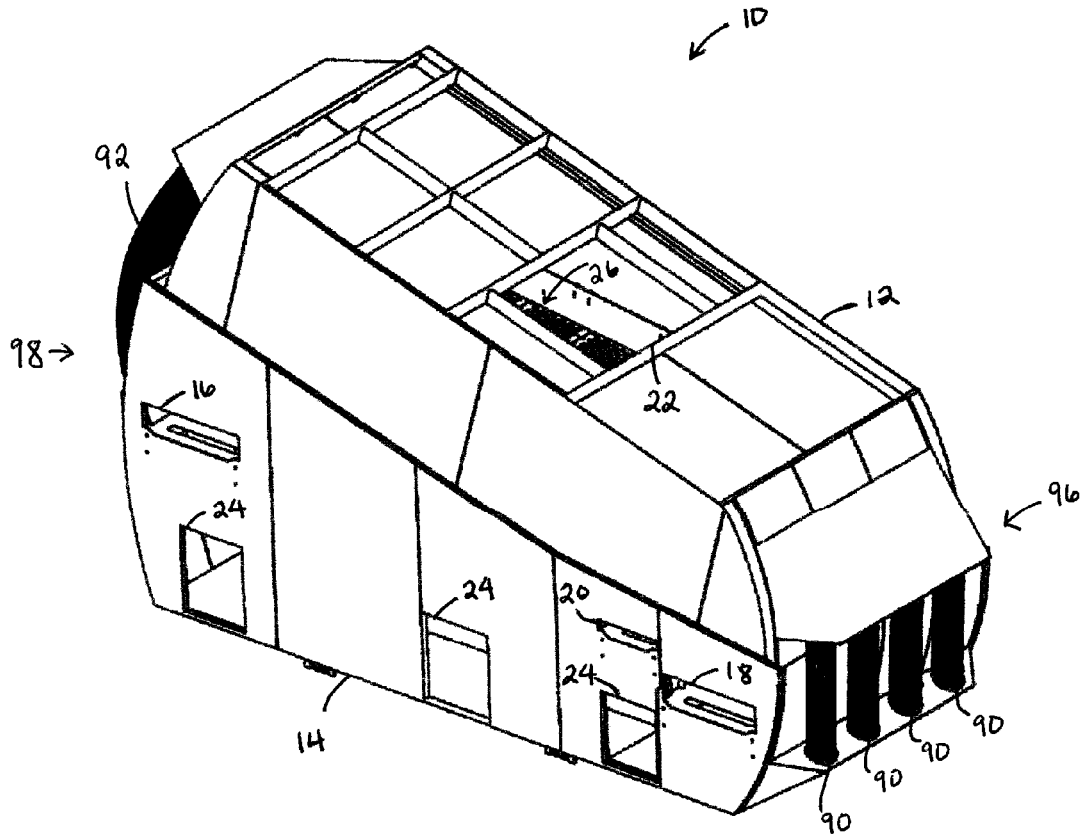
FIG. 1 is a perspective view of a separator according to one embodiment of the present invention.

Specific embodiments of the invention will now be described with reference to the accompanying drawings. This invention may, however, be embodied in many different forms and should not be construed as limited to the embodiments set forth herein; rather, these embodiments are provided so that this disclosure will be thorough and complete, and will fully convey the scope of the invention to those skilled in the art. The terminology used in the detailed description of the embodiments illustrated in the accompanying drawings is not intended to be limiting of the invention. In the drawings, like numbers refer to like elements.

Broadly speaking, the present invention provides a robust, economical to operate, and economical to maintain ballistic approach for the separation of mixed materials. An angled, unitary deck is connected to a system of statically interconnected counter weights driven by a single drive element. The deck is connected to the system of interconnected counter weights at connection points that are offset from the axes of rotation of the counter weights. Rotation of the system of counter weights results in a vertically circular oscillation of the deck. Oscillation of the deck, serves to separate mixed materials deposited upon the deck according to each material's ballistic properties and trajectory.

More particularly, with reference to FIG. 1, a separator 10 according to the present invention includes a cover 12, a housing 14, a first output port 16, a second output port 18, a third output port 20, and an input port 22. The input port 22 functions to receive materials for separation into the separator 10 and is located over an approximate midpoint of a deck 26 that is visible through the partially opened input port 22 shown in FIG. 1. The housing 14 may further employ one or more access ports 24 that function to allow access to various locations within the housing 14.

At a first end 96 of the separator 10 are air ducts 90 that span between the cover 12 and the housing 14. Similarly, at a second end 98 of the separator 10 are air ducts 92 that span between the cover 12 and the housing 14.

Figure 2:
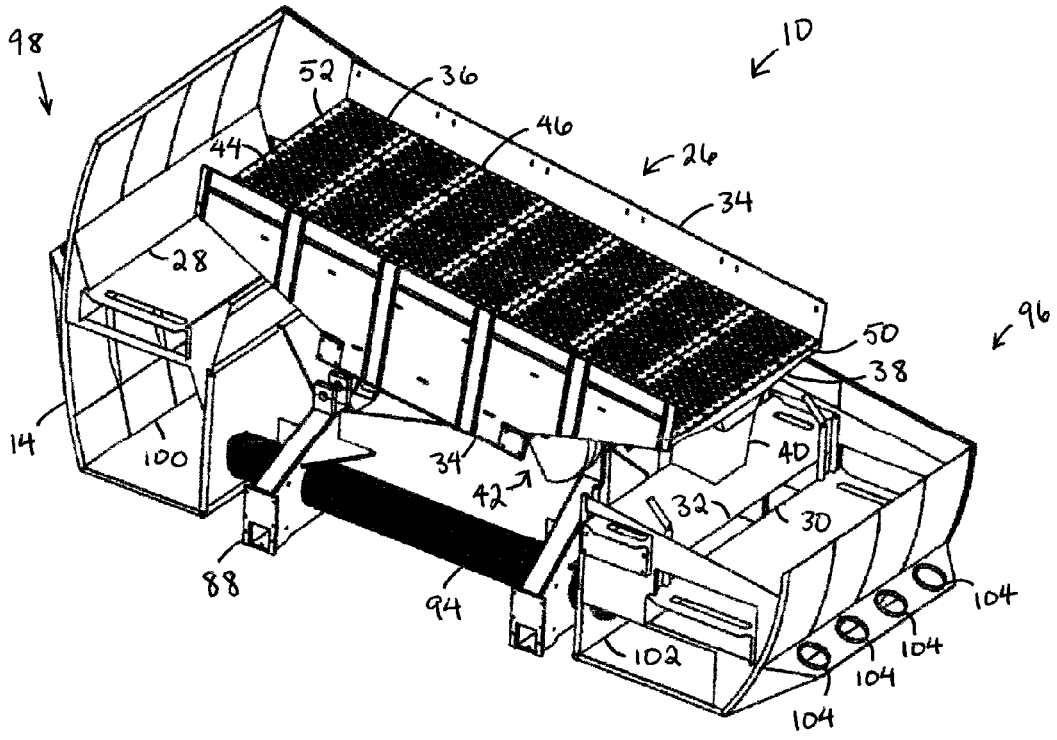
FIG. 2 is a perspective view of a portion of a separator according to one embodiment of the present invention.
Figure 3:
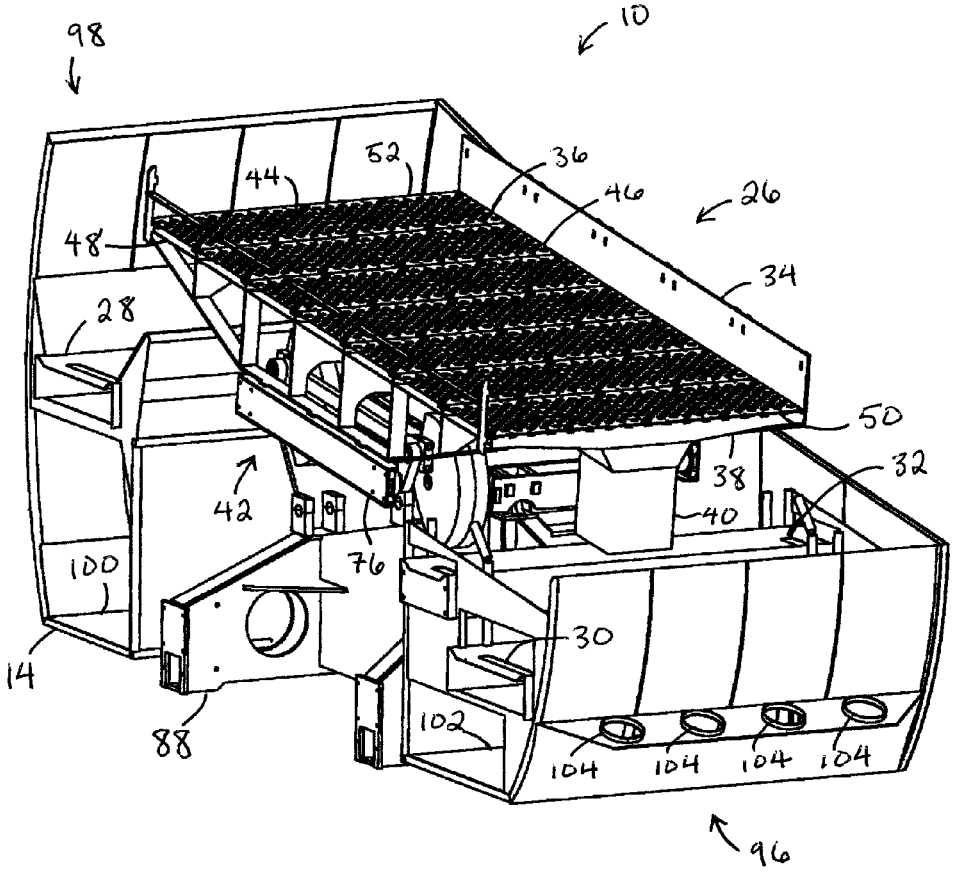
FIG. 3 is a perspective view of a portion of a separator according to one embodiment of the present invention.

FIGS. 2 and 3 are perspective views of the separator 10 with the cover 12 and certain side panels of the housing 14 and deck 26 removed for the sake of observation. The housing 14 is formed around a base 88. A drive system 42 couples the deck 26 to the base 88. The housing 14 includes, in part, a first output 28, a second output 30, and a third output 32. Located within the housing 14 below the first output 28 is a first air chamber 100. At an opposite end of the housing 14, below the second output 30 and the third output 32 is a second air chamber 102. A pair of air ducts 94 pass along opposite longitudinal sides of the base 88 below the deck 26. The air ducts 94 connect the first air chamber 100 to the second air chamber 102, thereby forming an air passage between the first air chamber 100 and the second air chamber 102.

The second air chamber 102 includes one or more ports 104. The air ducts 90 are connected to the ports 104 at a first end and to the similar ports formed in the cover 12 at a second end, thereby forming an air passage between the second air chamber 102 and the cover 12 at the first end 96 of the separator 10. Likewise, the first air chamber 100 includes one or more ports 104. One end of the air ducts 92 is connected to the ports 104 of the first air chamber 100, and a second end of the air ducts 92 is connected to the cover 12 at the second end 98 of the separator 10.

Accordingly, a closed-loop air flow path is formed from the first air chamber 100; through air ducts 94 to the second air chamber 102; through the air ducts 90 to the cover 12; through the cover 12 over the deck 26; and through the air ducts 92 back to the first air chamber 100. Within the air flow path, for example within the first air chamber 100, one or more blowers may be employed to force air through the air flow path. The direction of flow of air within the air flow path can be either as described above, i.e. in the direction of arrow 86 shown in FIGS. 2 and 3, or in the reverse direction. However, air flow in the direction of arrow 86 functions to assist in the efficient separation of certain mixed materials.

In certain embodiments of the present invention, the blower or blowers are operable to generate an air flow of approximately 8,800 cubic feet per minute. The rate of air flow may be adjusted by employing one or more adjustable blowers or by incorporating adjustable air constrictions, for example within air ducts 94. In yet another embodiment of the present invention, the air flow path, for example within the first air chamber 100, incorporates one or more air filtration systems.

The deck 26 includes, in part, side walls 34 that extend upward longitudinally along a side 46 and a side 48 of a screen 36. A side 50 and a side 52 of the screen 36 are not bordered by side walls. The screen 36 has a plurality of holes or apertures 44 dispersed across the screen 36. The screen 36 may employ a textured upper surface having gripping elements, for example, spikes or other protrusions extending upward. The screen 36 is statically elevated above a tray 38 having a similar or identical length and width as that of the screen 36. Connected to the tray 38 is a hollow tray manifold 40 having an opening oriented above the output 32.

Figure 4:
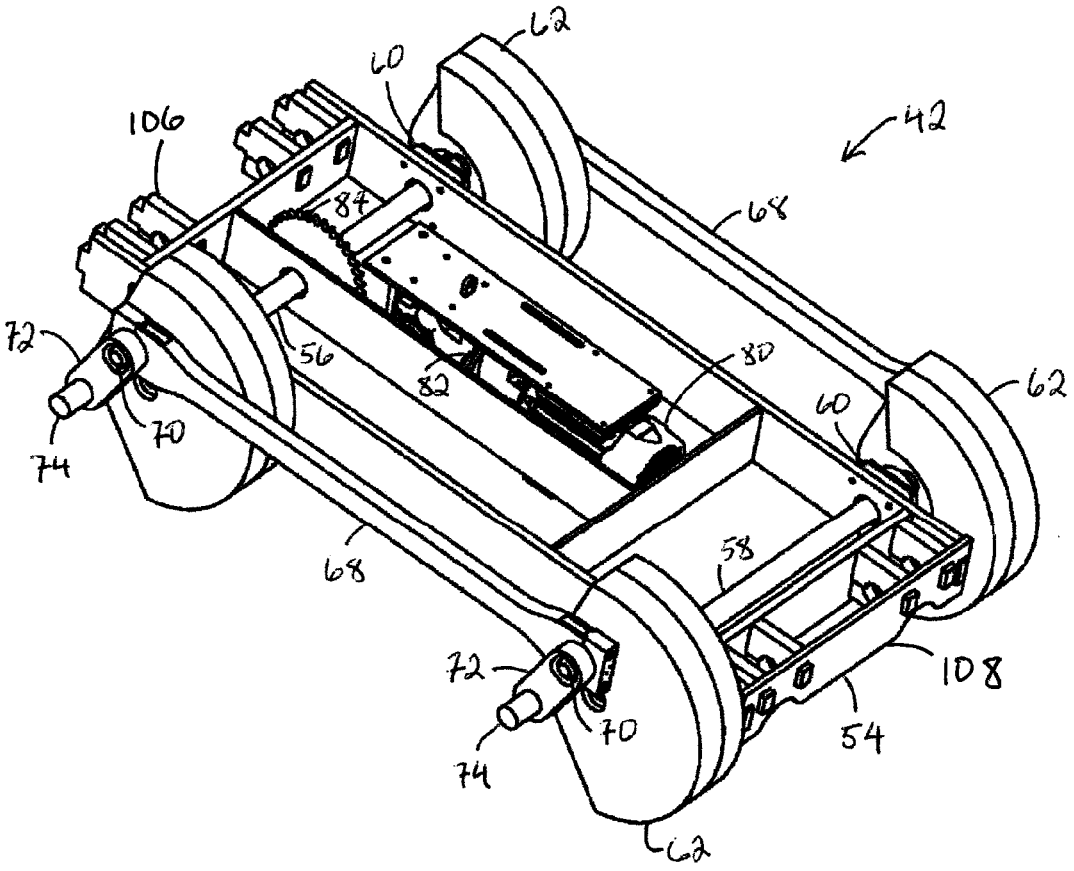
FIG. 4 is a perspective view of a drive system of a separator according to one embodiment of the present invention.
Figure 5:
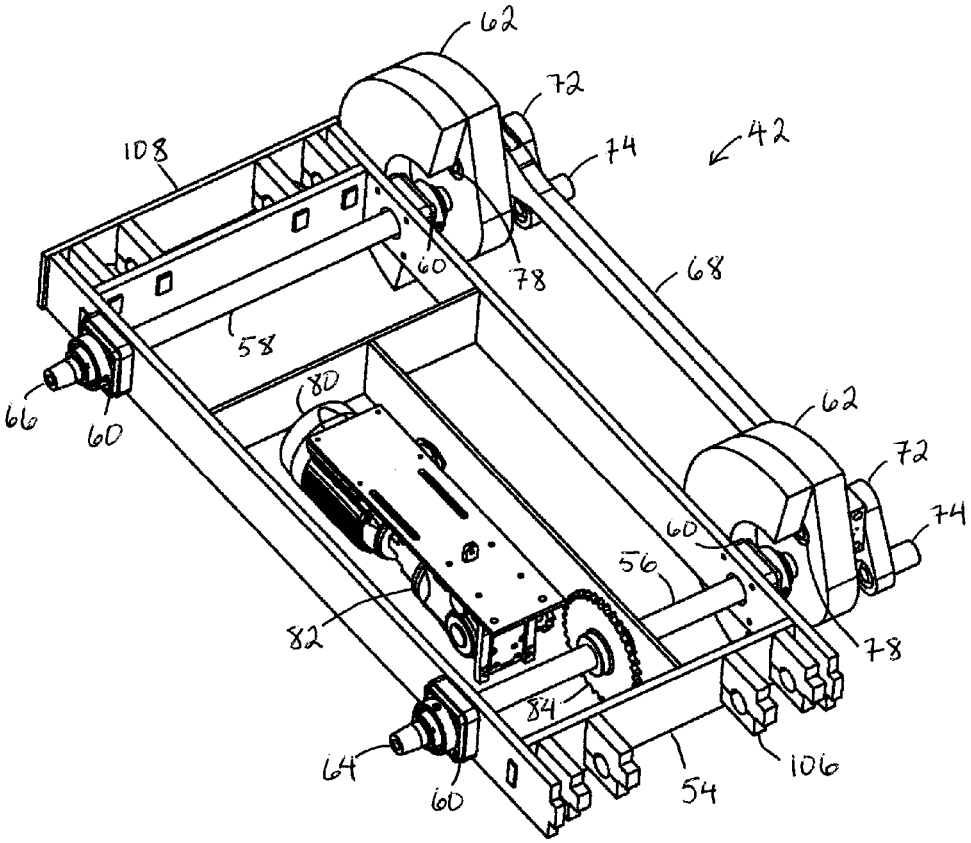
FIG. 5 is a perspective view of a portion of a drive system of a separator according to one embodiment of the present invention.
Figure 6:
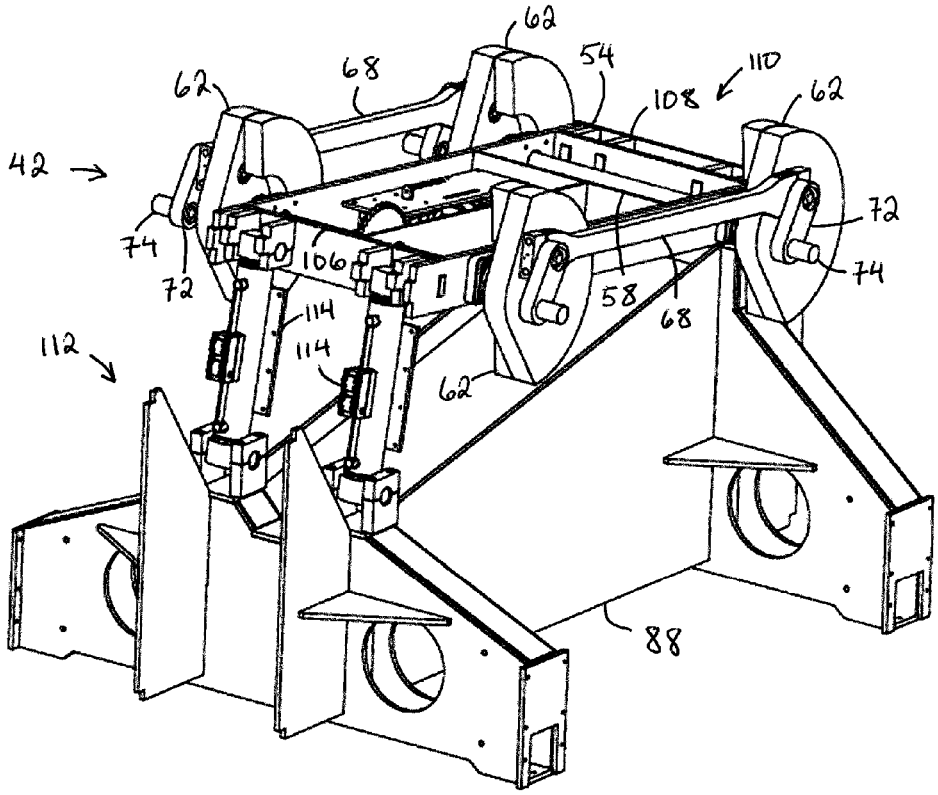
FIG. 6 is a perspective view of a base and a drive system of a separator according to one embodiment of the present invention

FIGS. 4-5 are perspective views of the drive system 42 according to one embodiment of the present invention. The drive system 42 employs a drive shaft 56 and a follower shaft 58 that pass through and are attached to a frame 54 by bearing assemblies 60 at end 106 and an end 108 of the frame 54, respectively. The end 108 of the frame 54 is pivotally attached to an end 110 of the base 88. An opposite end 106 of the frame 54 is attached to an end 112 of the base 88 by one or more adjusting elements 114. The adjusting element 114 may, for example be a hydraulic cylinder or threaded shaft. In certain embodiments of the present invention, the adjusting element 114 functions to allow for adjustment of an angle of the screen 36 of the deck 26 while the deck 26 is in operation or oscillating.

In other words, during operation of the separator 10, the adjustment element 114 allows the operator to elevate or lower the end 106 of the frame 54 relative to the fixed location or elevation of the end 108 of the frame 54. Hence, the side 52 of the screen 36, which is statically coupled to the end 106 of the frame 54, is elevated or lowered relative to the side 50 of the screen 36, which is statically coupled to the end 108 of the frame 54.

A counter weight 62 is attached to each end 64 of the drive shaft 54 and to each end 66 of the follower shaft 58. For clarity, only one end 64 of the drive shaft 54 and only one end 66 of the follower shaft 58 are shown in FIG. 5. The second, opposite end 64 of the drive shaft 54 and the second, opposite end 66 of the follower shaft 58 are obscured within the counter weights 62 shown in FIG. 5.

A link shaft 70 is attached to the counter weight 62 a hole 78 and projects from the counter weight 62 in a direction away from the frame 54. A first end of a link arm 68 is attached via a bearing assembly to the link shaft 70 of counter weight 62 of the drive shaft 56 and a second end of the link arm 68 is attached via a bearing assembly to the link shaft 70 of the counter weights 62 of the follower shaft 58 that is positioned on the same side of the frame 54. Similarly, a second link arm 68 is attached to the link shafts 58 of the counter balances 62 and the link shaft 70 of the counter weights 62 of the follower shaft 58 positioned on the opposite side of the frame 54, as shown in FIG. 4. As shown in FIG. 5, the holes 78 are formed into or through the respective count weight 62 so as to be offset from the axes of rotation of the counter weights 62 about the drive shaft 56 and follower shaft 58.

To each of the link shafts 70 projecting from each of the counter weights 62 is attached, via a bearing assembly, a cam arm 72. Opposite the ends of the cam arms 72 attached to the link shafts 70 are output shafts 74. The output shafts 74 protrude from the cam arms 72 in a direction away from the frame 52. For clarity, the opposite side's drive assembly including the counter weights 62 and the associated link shafts 70, cam arms 72, output shaft 74, and link arm 68, have been omitted from FIG. 5.

Each of the output shafts 74 are, in turn, connected to the deck 26 by bearing assemblies incorporated into or otherwise attached to a deck bracket 76, shown in FIG. 3. The deck 26 employs one deck bracket 76 on each longitudinal side of the deck 26. One end of each deck bracket 76 is attached to the output shaft 74 associated with the drive shaft 56 and an opposite end of each deck bracket 76 is attached to the output shafts 74 associated with the follower shaft 58.

In certain embodiments of the present invention, a dimension of the travel or a diameter of the oscillation of the deck 26 is adjustable through adjustment or rotation of the individual cam arms 72 about the link shaft 74 and/or through interchanging cam arms 72 having different lengths. The dimension of travel or the diameter of the rotation of the deck 26 is up to eight inches or greater, for example 12 inches. The dimension of travel or diameter of rotation of the deck 26 is a function of a dimension of the offset of the axes of the output shafts 74 coupled to the drive shaft 56 from the axis of rotation of the drive shaft 56, and similarly, is a function of a dimension of offset of the axes of the output shafts 74 coupled to the follower shaft 58 from the axis of rotation of the follower shaft 58. This dimension of offset is directly proportional to the dimension of travel or a diameter of the rotation of the deck 26, however, as rotational speed of the deck increases, this proportional relationship may vary due to inherent flex in the system.

In certain embodiments of the present invention, adjustment of the dimension of travel or the diameter of the rotation of the deck 26 is possible through adjustment members, for example hydraulic cylinders, that link ends of the cam arms 72 attached to the deck brackets 72 to a point on the counter weights 62 apart from the link shafts 70. Such adjustment members are operated in unison and allow for adjustment of the dimension of travel or the diameter of the rotation of the deck 26 during operation of the separator 10.

The drive system 42 further includes a drive element 80. The drive element 80 may, for example, be a combustion, a hydraulic, an electric or other form of motor or a combination thereof. The drive element 80 is associated with a drive gear 84 which, in turn, is associated with the drive shaft 56. The drive element 80 may, for example, directly engage and drive the rotation of the drive gear 84 through rotation of a gear that is in direct contact with the drive gear 84. Alternatively, a chain or drive belt may be employed to communicate an output rotation from the drive element 80 to the drive gear 84.

While the present figures and disclosure shows and describes only one drive element 80 that drives or is otherwise associated with the drive gear 84 and the drive shaft 56, it is contemplated that a plurality of drive elements 80 may drive or otherwise be associated with the drive gear 84 and the drive shaft 56.

In certain embodiments of the present invention, a gear box 82 may be employed between the drive element 80 and the drive gear 84. The gear box 82 may but need not necessarily employ a clutch system. The gear box 82 may be associated with the drive element 80 and the drive gear 84 through, for example, direct engagement or through a drive belt or a chain.

In operation, activation of the drive element 80 functions to rotate the drive gear 84 which, in turn, rotates the drive shaft 56 and the counter weights 62 attached to each end of the drive shaft 56. The rotation of the counter weights 62 associated with the drive shaft 56 is communicated through the link arms 68 to the counter weights 62 associated with the follower shaft 58, thereby resulting in a synchronized rotation of all of the counter weights 62. The synchronized rotation of the counter weights 62 is, in turn, communicated to the deck 26 through the rotation of the link shafts 70, the cam shafts 72, and the output shafts 74 and through the coupling of the output shafts 74 to the deck brackets 76. A vertically circular rotation of the deck 26 is achieved due to the offset orientation of the link shafts 70 relative to the axes of rotation of the drive shaft 56 and the follower shaft 58.

As shown in FIGS. 1-3, the screen 36 of the deck 26 is angled relative to the housing 14. The side 52 of the screen 36 is elevated higher than the side 50 of the screen 36. While the figure show the screen 36 of the deck 26 as angled in only one axis it is contemplated that the screen 36 may, in certain embodiments, be angled in a second axis, for example, such that one of the sides 46 and 48 is elevated above the other. From the perspective of FIGS. 1-3, the direction of rotation of the deck 26 is clockwise, as indicated by arrow 86.

As mixed materials are deposited through the input 22 onto the screen 36 of the deck 26, the oscillating motion of the deck 26 functions to separate the mixed materials into at least three distinct types. Relatively light materials, for example, two-dimensional materials such as fibers, films, and certain flattened materials migrate towards the side 52 of the screen 36 and into the first output 28. Relatively heavy materials, for example, three-dimensional materials such as plastic, metal and certain large dimensional fibers migrate towards the side 50 of the screen 36 and into the second output 30. Finally, materials of a relatively small dimension or fines, for example, crushed glass, shredded paper, and certain organic materials fall through the apertures 44 of the screen, onto the tray 38. Due to the orientation and motion of the tray 38, the small dimensional materials migrate towards and through the tray manifold 40 and into the third output 32.

The separated materials are transferred out from the first output 28, the second output 30, and the third output 32 through the first output port 16, the second output port 18, and the third output port 20, respectively. In certain embodiments, the transfer is facilitated by conveyor systems or other similar transfer systems.

The separator 10 of the present invention provides numerous advantages over existing separators. For example, the separator 10 of the present invention is operable to achieve an adjustable oscillation or travel of up to approximately ten inches or greater, for example 12 inches; roughly twice the travel achieved by known separators. This increased travel, in turn, provides increased throughput capacity over known separators. Furthermore, the lower profile of the separator 10 relative to known separators allows for operation of the separator 10 in building having relatively low ceilings. Due to the presence of fewer components that are prone to wear, that are exposed to falling fines, and that require calibration, the separator of the present invention also requires less maintenance and thereby achieves lower operating cost relative to known separators that employ discs or multiple motors or drive elements.

The separator 10 according to the present invention also advantageously incorporates an adjustable, closed or semi-closed air flow path over the materials being sorted. When the air flow is in the direction of arrow 83 shown in FIGS. 2 and 3, the air flow enhances the migration of two-dimensional materials, such as certain fibers, up the deck 26 towards the output 28. In other words, the air flow through the closed or semi-closed air flow path enhances the separation efficiency of the separator 10. Additionally, when an air filtration system is employed within the air flow path of the separator 10, the resulting sorted materials contain reduced contaminates, thereby increasing efficiency of the separation process. Furthermore, due to the air filtration system within the air flow path, the separator 10 experiences reduced contamination and wear from airborne particulates, thereby decreasing maintenance and repair costs.

Finally, the separator 10 according to the present invention advantageously allows an operator to adjust the angle of the screen 36 of the deck 26 without stopping operation of the separator 10. The separator 10 allows for fine or infinite adjustment of the screen 26 so as to optimize separation of varying streams of mixed materials. Known separators, if operable for adjustment of the screen or separation surface angle, must be stopped in order to facilitate such adjustment. Accordingly, the present invention provides increased separation efficiency by allowing for adjustment of the separator 10 without having to actually stop the separation process.

Although the invention has been described in terms of particular embodiments and applications, one of ordinary skill in the art, in light of this teaching, can generate additional embodiments and modifications without departing from the spirit of or exceeding the scope of the claimed invention. Accordingly, it is to be understood that the drawings and descriptions herein are proffered by way of example to facilitate comprehension of the invention and should not be construed to limit the scope thereof.

What is claimed is:

1. A method for separating mixed materials comprising:

depositing a plurality of mixed materials upon a horizontally oriented unitary deck having a first longitudinal end that is opposite from a second longitudinal end, the first longitudinal end elevated higher than an elevation of the second longitudinal end;

rotating the unitary deck vertically;

migrating a first portion of the plurality of mixed materials having similar physical characteristics off the first longitudinal end of the unitary deck through said rotation of the unitary deck; and migrating a second portion of the plurality of mixed materials having similar physical characteristics off the second longitudinal end of the unitary deck through said rotation of the unitary deck.

2. The method according to claim 1 wherein the step of depositing a plurality of mixed materials upon a horizontally oriented unitary deck having a first longitudinal end that is opposite from a second longitudinal end, the first longitudinal end elevated higher than an elevation of the second longitudinal end comprises adjusting an elevation of the first longitudinal end of the unitary deck relative to the elevation of the second longitudinal end of the unitary deck.

3. The method according to claim 1 wherein the step of rotating the unitary deck vertically comprises rotating a unitary deck to which a screen is statically attached.

4. The method according to claim 1 further comprising the step of migrating a third portion of the plurality of mixed materials through the unitary deck.

5. The method according to claim 1 further comprising the step of passing a portion of a closed-loop air flow path above the unitary deck.

* * * * *